United States Patent [19]

Calabretta et al.

[11] 4,005,978

[45] Feb. 1, 1977

[54] CANDLE WAX COMPOSITION

[75] Inventors: Peter J. Calabretta, Bayside Hills; Frank J. Keppel, Brooklyn, both of N.Y.

[73] Assignee: Felton International, Inc., Brooklyn, N.Y.

[22] Filed: Mar. 4, 1975

[21] Appl. No.: 555,206

[52] U.S. Cl. ..... 431/288; 44/7.5; 106/270

[51] Int. Cl.[2] ..... C10L 5/00; C11C 5/00

[58] Field of Search ..... 44/7.5; 106/270–272; 208/24; 431/288

[56] References Cited

UNITED STATES PATENTS

| | | | |
|---|---|---|---|
| 2,638,411 | 5/1953 | Thompson | 44/7.5 |
| 2,960,519 | 11/1960 | Marr et al. | 208/24 |

*Primary Examiner*—Theodore Morris

*Attorney, Agent, or Firm*—Blum, Moscovitz, Friedman & Kaplan

[57] ABSTRACT

The characteristic vortex which develops in wax candles after casting and cooling is greatly reduced in depth by the incorporation of a selected additive. The additive lowers the density of the composition without adversely affecting the appearance of the product.

7 Claims, 1 Drawing Figure

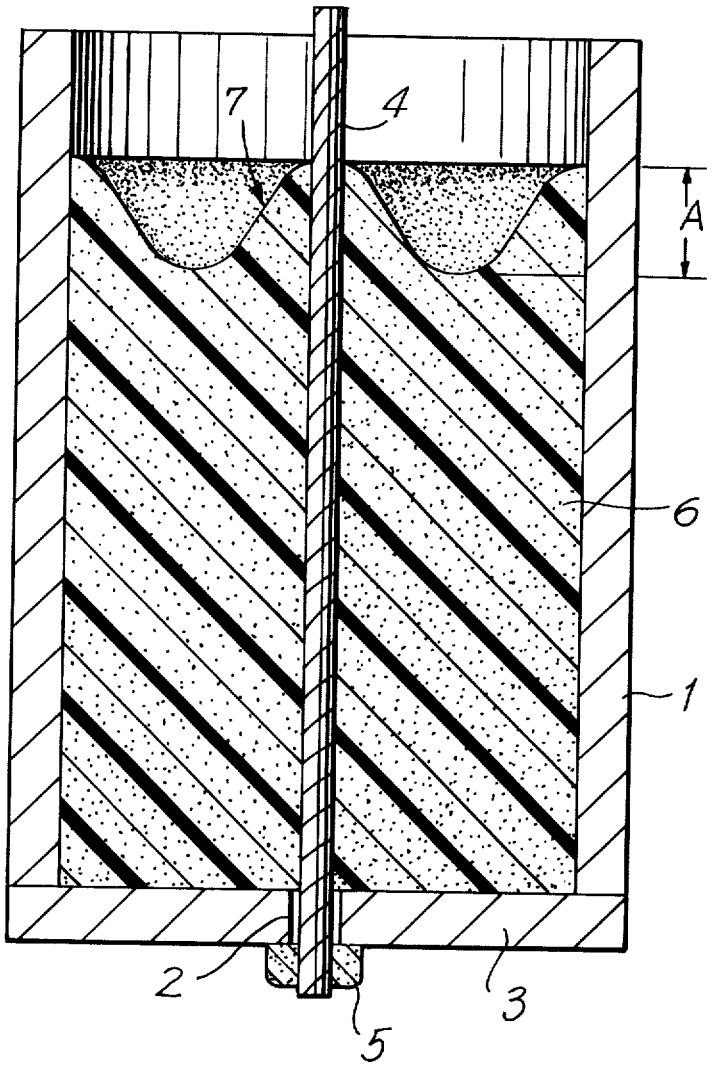
7
4
A
6
1
2
3
5

CANDLE WAX COMPOSITION

BACKGROUND OF THE INVENTION

In the making of candles, the wax composition which may include both a fragrance and a color, is melted and poured into a mold in which it is allowed to cool. Characteristically, the mold is of aluminum and the wax cools and hardens by transfer of heat through the aluminum to the ambient air. The process is relatively slow, particularly where the candle is large in diameter, since most of the heat transfer takes place through the molded side wall of the candle.

Organic materials, in general, wax being no exception, have large coefficients of thermal expansion. Since the wax is customarily heated to a temperature of about 90° C in the casting process, and the melting point is close to 70° C, a considerable temperature drop must take place, as a result of which a considerable contraction must occur. However, since the mold is initially cold the wax which makes contact with the side wall of the mold solidifies first, and, therefore, forms a periphery which, in height, corresponds closely to the height at the time when the wax in contact with the side wall first solidifies. The wax in the interior of the candle, however, shrinks as it cools, the shrinkage continuing until solidification throughout the mass has taken place. The wax in immediate contact with the wick which is put in place before the wax is poured into the mold also establishes itself at a height which is approximately the same as that of the periphery of the candle.

The annular valley between the wick and the periphery of the candle is of such depth that the purchaser of such a candle feels that he has been treated unfairly in that the candle, for the most part, is not of the height attributed to it. Thus, a candle sold as a 6-inch candle is actually 6 inches high only at the periphery or at the center. Alternatively, the candle at these particular regions must be made substantially taller if the height of the candle at the low point of the valley is to be 6 inches. This, of course, represents a loss to the vendor in that the quantity of wax necessary for such a construction is increased above what would be the case if the candle were essentially flat at the top. Consequently, it would be highly desirable if a candle could be cast in such a way that the top would be essentially flat, or, at least, if the depth of the valley could be substantially decreased.

At the present time, the only means by which the difficulty can be avoided is to cast the candle in two or more stages. Thus, the valley or vortex must be filled in a second pouring in which some shrinkage, of course, also occurs. Consequently, it frequently happens that several pourings are necessary, especially where the candle is three or four times as great in height as in diameter.

Most commercial candles are colored; furthermore, most commercial candles have a fragrance incorporated. These ingredients have little or no effect on the depth of the vortex. Also, it is common to add stearic acid to the composition, the purpose being to provide the candle with a glossy exterior. Again, this ingredient does not affect the depth of the vortex.

SUMMARY OF THE INVENTION

Characteristically, candle compositions include a candle wax which must be heated to about 70° C in order to melt it, a fragrance, a color body and stearic acid. The addition of from 0.5 to 1.5% of phthalic anhydride reduces the depth of the vortex to an extent such that candles prepared by a single pouring have been found acceptable. In the mixing of the ingredients, the phthalic anhydride and the stearic acid are first melted and then allowed to set into solid form. This solid mass is then powdered so that it will go into solution in the wax rapidly. The wax is melted, the powdered phthalic anhydride — stearic acid mix is added to the wax with stirring, after which the fragrance is added with stirring. The mix is poured into a mold and the wax is allowed to cool at room temperature.

Phthalic anhydride substantially reduces the depth of the vortex which forms on cooling.

Accordingly, an object of the present invention is a wax-candle composition which, on casting, forms a candle having a vortex which is substantially reduced in depth relative to that which is formed in the absence of the phthalic anhydride ingredient used in the composition disclosed herein.

Another object of the present invention is a wax-candle composition of lower density than that of conventional candles.

A further object of the present invention is a candle which is acceptable when prepared in a single pouring, the criterion of acceptability being the depth of the vortex which forms on cooling in a mold.

A significant object of the present invention is a method of casting in a mold a candle where said candle has a vortex of acceptable depth without the necessity for more than one pouring.

Still other objects and advantages of the invention will in part be obvious and will in part be apparent from the specification.

The invention accordingly comprises the several steps and the relation of one or more of such steps with respect to each of the others, and also a composition of matter possessing the characteristics, properties and the relation of constituents which will be exemplified in the compositions hereinafter described, and the article possessing the features, properties and the relation of elements which are exemplified in the following detailed disclosure, and the scope of the invention will be indicated in the claims.

BRIEF DESCRIPTION OF THE DRAWING

For a fuller understanding of the invention, reference is had to the following description taken in connection with the accompanying drawing, in which:

The single FIGURE is a cross-sectional view in elevation of a cast candle in a mold prior to removal of the candle from the mold.

DESCRIPTION OF THE PREFERRED EMBODIMENTS

The single FIGURE shows the type of depression which forms in the surface of a cast wax candle during the cooling process. The mold is conveniently made of aluminum and is columnar. Thus, the mold may be cylindrical, square, hexagonal, or any other convenient shape in cross-section. However, in the examples which will be presented, the mold was, in all cases, cylindrical, the type of deformation resulting during the cooling process being essentially similar for all types of cross-sections.

To prepare a candle by casting, a composition is first prepared and heated sufficiently so that it becomes molten. The mold is prepared as follows: A mold 1 having an opening 2 at the center of the bottom plate 3 is turned on its side or otherwise supported so that the bottom surface becomes accessible. A wick 4 is positioned axially in the mold, the wick being held at the bottom of the mold by a piece of gum 5, and at the top by any convenient means such as by attaching to a rod (not shown) across the top of the mold.

The gum also seals the opening 2. The mold is then set down on a surface in preparation for casting. The molten wax composition is poured into the mold 1 and forms candle 6. As will be seen, there is an annular depression 7 termed a vortex at the top of the candle. The depth of the vortex is indicated by the letter A.

In order to show the effects of phthalic anhydride on the vortex, candles were cast both with and without the phthalic anhydride additive. The candles were cast at heights of 3 inches, 6 inches and 9 inches, the purpose being to indicate how the depth of the vortex varies with the height of the candle. Following are the results obtained in the three series of castings.

EXAMPLE 1

Three inch high × three inch diameter candle. (3 × 3 inch) Charge:

241.3 g. wax (paraffin wax melting at about 60° C – 80° C, Philips Petroleum, Standard Oil of New Jersey, etc.)
5.0 g. fragrance (Bayberry)
2.0 g. phthalic anhydride in powder form (Aldrich Chemical Co.) 99% purity
1.7 g. stearic acid (Emersol 220, Emery Industries Inc.)
0.03 g BASF (Wyandotte Corp.) a yellow dye Procedure:

1. The phthalic anhydride and the stearic acid were melted together at about 90°–100° C and allowed to set into a solid form. Then this solid mass was crushed to a powder to increase the rate of solution in the candle wax.
2. The wax was melted in a stainless steel pot of suitable size on a hot-plate and brought to about 120° C.
3. The phthalic anhydride/stearic acid mix was added to the wax with stirring.
4. The fragrance was added with stirring.
5. The oil-soluble dye was added with stirring, this addition being optional and without effect other than providing color to the product. If desired, the dye may be dissolved in a portion of stearic acid to serve as a stock "solution".
6. The composition was poured into a 3 inch inside diameter aluminum mold.
7. The candle was allowed to cool in the mold to room temperature.
8. The depth of the vortex was measured to the nearest 1/16 inch.

Note: The dye used should be of the oil-soluble type.

Six candles were made in accordance with the above procedure and six additional candles were prepared as controls, these latter six candles having no phthalic anhydride additive therein. The range of depths of the vortex (A) for the candles with additive was 6/16–7/16 inches. The range of control candles (without additive) was 10/16 – 15/16 inches. The average depth for the first six candles was 7/16 inches and for the second six candles was ⅞ inches.

From these results, it can be seen that incorporation of the additive at a level of 0.8% in a three-inch high × three inch diameter candle cuts the vortex depth by a factor of about 2.

EXAMPLE 2

Six inches high × three inches in diameter candle.
Charge:

488 g. wax
9 g. fragrance (Lemon)
2.5 g. phthalic anhydride
0.5 g. stearic acid

Procedure: Same as Example 1.

Five candles were prepared with the additive and five without the additive. The range of vortex depths for the five candles with the additive was ½ – ¾ inches, while the range of vortex depths for the five candles made without the additive was 1 15/16 – 3 inches. The average depth of vortex for the candles with the additive was ⅝ inches and for the candles without the additive was 2 inches.

As is evident, for a six inch high candle having a diameter of 3 inches, the reduction provided by 0.5% of phthalic anhydride additive corresponds to a factor of about 3. The reason why the reduction is greater for the taller candles is not understood, particularly in view of the fact that the concentration of additive used was smaller than in Example 1.

EXAMPLE 3

Six inch high × three inch diameter candles, using no stearic acid.
Charge:

487.5 g. wax
9.0 g. fragrance (Pine)
3.5 g. phthalic anhydride.

Procedure:

1. The wax was melted, then heated to about 110° C, in a suitable sized pot.
2. The phthalic anhydride was added with stirring.
3. The fragrance was added with stirring.
4. The mixture was decanted into the mold.
5. The candle was allowed to cool in the mold to room temperature.

Seven candles were prepared from the composition shown above and seven control candles were prepared, these lacking phthalic anhydride as well as stearic acid. The range of vortex depths for the seven candles prepared as above was from 9/16 inch to 15/16 inch, the average being 13/16 inch. The range of vortex depths for the seven control candles was 2 and 13/16 inch to 3 and 5/16 inch, the average being 3 and ¼. As is evident, removal of the stearic acid does not affect the results as found in Example 2. The phthalic anhydride concentration was 0.7%.

EXAMPLE 4

Nine inch high × three inch diameter candles, using no stearic acid.
Charge:

955.8 g. wax
10.8 g. phthalic anhydride
16 g. fragrance (Bayberry)

Procedure: as in Example 3.

Three candles were prepared with the additive and three without the additive. The range of vortex depths for the three candles with the additive was 6/16 inch to 12/16 inch, while the range of vortex depths for the three candles made without the additive was 2 and ¾ inch to 3 and 3/16 inch. The average depth of vortex for the candles with the additive was 9/16 inches and for the candles without the additive was 3 inches.

Tests have shown that the minimum quantity of phthalic anhydride effective for the purposes disclosed herein is about 0.5%.

It will be noted that the reduction ratio obtained in this Example was substantially greater than in the other examples. The reason obviously is that the proportion of additive used was 1.1% by weight and was therefore greater than in the other examples so that it is readily seen that the reduction ratio is a function of the quantity of additive incorporated in the composition.

The maximum quantity of phthalic anhydride which can be added is about 1.5%. If the quantity added is greater than this, mottling and scaling of the candle become apparent. The suitable range for the additive is therefore 0.5 – 1.5%. The reduction in the depth of the vortex resulting from the use of phthalic anhydride additive in the range specified is sufficient so that candles of the compositions exemplified are acceptable. In contrast, when candles are prepared without the additive, it is necessary to fill the vortex at least once more after the initial casting and cooling.

No explanation is at hand for the effectiveness of phthalic anhydride in reducing the depth of the vortex. As would be expected, the fact that the depth of the vortex is decreased necessarily indicates that the volume of the candle produced with phthalic anhydride therein is greater than in the absence of this additive. Consequently, the density of the product must also be lower. Nevertheless the candle does not appear to be foamed even when sectioned so that the interior can be examined.

Another significant finding is that the addition of phthalic anhydride is ineffective in reducing the vortex depth when other common waxes are used, an example being beeswax.

It will thus be seen that the objects set forth above, among those made apparent from the preceding description, are efficiently attained and, since certain changes may be made in carrying out the above method, in the product and in the composition set forth without departing from the spirit and scope of the invention it is intended that all matter contained in the above description and shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved wax-candle composition suitable for preparing a cast candle therefrom in a single pouring, said improvement comprising the combination of paraffin wax as the major component in said composition, and about 0.5% to 1.5% by weight of phthalic anhydride, said paraffin wax having a melting point between about 60° C and about 80° C.

2. The improved composition as defined in claim 1, wherein said composition includes a minor quantity of a fragrance.

3. The improved composition as defined in claim 1, wherein said composition includes a minor quantity of stearic acid for the purpose of adding gloss to the exterior surface of said candle.

4. The improved composition as defined in claim 1 wherein said composition includes a minor quantity of at least one of a fragrance and a coloring agent.

5. The improved composition as defined in claim 1 further comprising about 2% by weight of a fragrance, about 0.7% of stearic acid, and, optionally, a selected quantity of a coloring agent.

6. An improved single-pour wax candle having a vortex of reduced depth, wherein said improvement comprises the combination of a wick and a composition consisting essentially of paraffin wax and about 0.5 to 1.5% of phthalic anhydride, apart from minor ingredients, said paraffin wax having a melting point between about 60° C and about 80° C.

7. The improved single-pour wax candle as defined in claim 6, wherein said minor ingredients include at least one of stearic acid, a fragrance and a coloring agent.

* * * * *